US010562669B2

(12) United States Patent
Monckton et al.

(10) Patent No.: US 10,562,669 B2
(45) Date of Patent: Feb. 18, 2020

(54) SUPPORT FOR BOTTLES

(71) Applicant: LALLEMAND INC., Rexdale (CA)

(72) Inventors: Richard Monckton, Canaan, NH (US); Sean Covalla, Thetford Center, VT (US)

(73) Assignee: LALLEMAND INC., Reidale, Ontario ( * ) Notice: Subject to any disclaimer, the term of this patent is extended or adjusted under 35 U.S.C. 154(b) by 336 days.

(21) Appl. No.: 15/606,591

(22) Filed: May 26, 2017

(65) Prior Publication Data

US 2018/0339295 A1 Nov. 29, 2018

(51) Int. Cl.
*B65D 23/00* (2006.01)

(52) U.S. Cl.
CPC .... *B65D 23/001* (2013.01); *B01L 2300/0809* (2013.01)

(58) Field of Classification Search
CPC ..... B65D 23/001; B01L 2300/0809
USPC ..... 422/556
See application file for complete search history.

(56) References Cited

U.S. PATENT DOCUMENTS

2006/0087911 A1 4/2006 Herz et al.

*Primary Examiner* — Jill A Warden
*Assistant Examiner* — Jacqueline Brazin
(74) *Attorney, Agent, or Firm* — Norton Rose Fulbright Canada

(57) ABSTRACT

A support that comprises a plate having a first side and a second side opposed to the first side. The plate has a sample section including bottle-receiving members defined in the first side and configured for holding the bottles in a fixed position relative to the plate, and first conduit-receiving openings extending from the first side to the second side for receiving conduits extending from the bottles. The plate has a manifold section including second conduit-receiving openings extending from the first side to the second side for receiving the conduits. The plate has a channel section including channels defined in the second side and extending between the first conduit-receiving openings and the second conduit-receiving openings for receiving the conduits therein. The support may be used for example on a shaker. A method for retaining bottles and conduits connected to the bottles is also discussed.

17 Claims, 5 Drawing Sheets

SUPPORT FOR BOTTLES

TECHNICAL FIELD

The application relates generally to sample processing stations and, more particularly, to systems and methods used to support sample bottles, or flasks, in such stations.

BACKGROUND OF THE ART

In an industrial context, efficiency and profits increase by increasing a number of sample bottles that are processed simultaneously. For example, when processing a plurality of bottles on a shaker, spring holders are typically used to retain the bottles individually. Each bottle is connected via a respective conduit to one or more sensor(s) for monitoring the process. However, the number of bottles that can be processed simultaneously is limited by the capacity of the spring holders. Moreover, increasing the number of sample bottles may render the processing fastidious in part because all of the conduits connecting the bottles to the sensors may become entangled and/or mixed up. Therefore, the gain in efficiency associated in part to the increased number of bottles simultaneously processed may be overshadowed by the above mentioned drawbacks.

SUMMARY

There is provided a support for receiving bottles each connected to a respective conduit, the support comprising: a plate having a first side and a second side opposed to the first side, wherein: the first side of the plate has bottle-receiving openings defined therein; the plate further has first conduit-receiving openings defined therethrough extending from the first side to the second side, each of the bottle-receiving openings adjacent an associated one of the first conduit-receiving openings; the plate further has at least one second conduit-receiving opening defined therethrough extending from the first side to the second side; and the second side of the plate has at least one channel defined therein, the at least one channel extending between the first conduit-receiving openings and the at least one second conduit-receiving opening; wherein the first conduit-receiving openings, the at least one channel, and the at least one second conduit-receiving opening are configured so that each of the bottles is receivable within one of the bottle-receiving openings with the respective conduit extending from the bottle through the plate in the associated one of the first conduit-receiving openings, along the second side within one of the at least one channel, and back through the plate in one of the at least one second conduit-receiving opening.

There is further provided a support for receiving bottles, the support comprising: a plate having a first side and a second side opposed to the first side, the plate having: a sample section including bottle-receiving members defined in the first side and configured for holding the bottles in a fixed position relative to the plate, and first conduit-receiving openings extending from the first side to the second side for receiving conduits extending from the bottles; a manifold section including second conduit-receiving openings extending from the first side to the second side for receiving the conduits; and a channel section including channels defined in the second side and extending between the first conduit-receiving openings and the second conduit-receiving openings for receiving the conduits therein.

There is yet provided a method for retaining bottles and conduits connected to the bottles, the method comprising: engaging the bottles in bottle-receiving members on a first side of a plate of the support; inserting each conduit in a first conduit-receiving opening so that the conduit extends through the plate; guiding each conduit from the first conduit-receiving opening along an opposed second side of the plate toward a second conduit-receiving opening; and inserting the conduit in the second conduit-receiving opening so that the conduit extends back through the plate.

There is yet further provided an assembly comprising the support as described herein, the assembly further including: bottles disposed in the bottle-receiving members; at least one sensor received on the plate; and conduits connecting the bottles to the at least one sensor, the conduits each extending from a respective one of the bottles through the plate in one of the first conduit-receiving openings, along the second side within one of the at least one channel, and back through the plate in one of the at least one second conduit-receiving opening.

DESCRIPTION OF THE DRAWINGS

Reference is now made to the accompanying figures in which.

DETAILED DESCRIPTION

Figure 1:
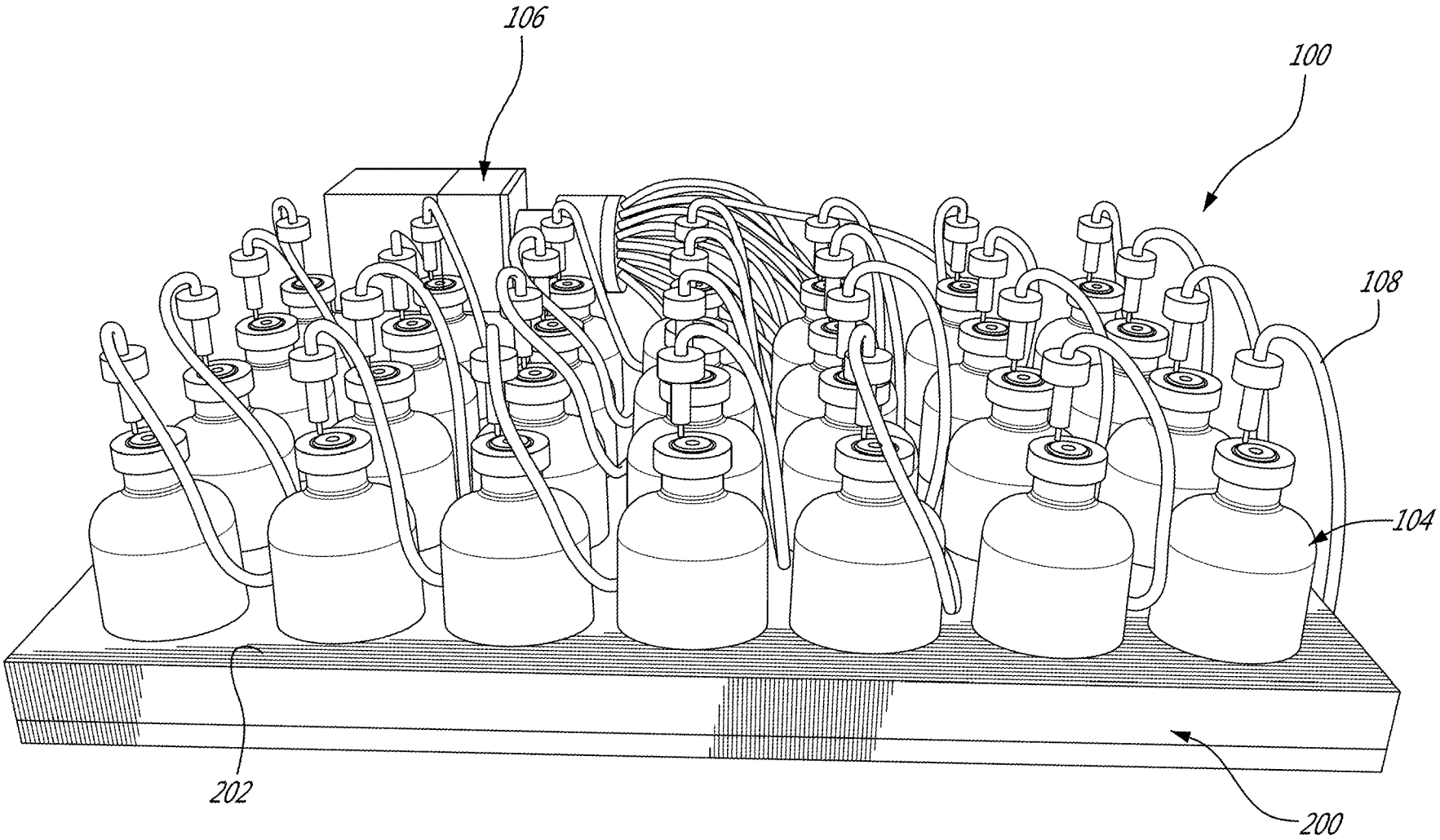
FIG. 1 is a schematic tridimensional view of an assembly comprising a support holding bottles in accordance with one embodiment.
Figure 2:
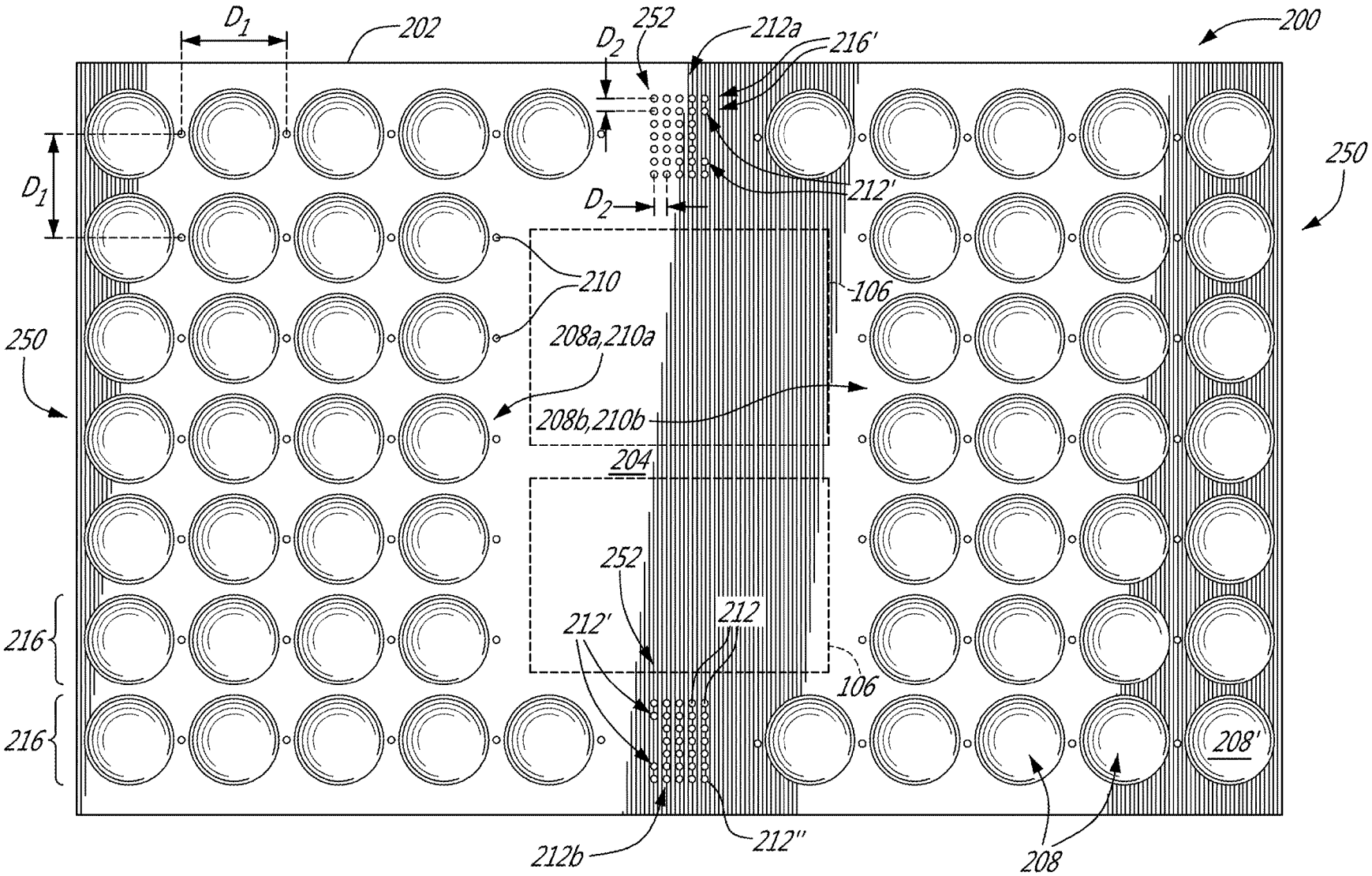
FIG. 2 is a schematic top view of the support of FIG. 1.
Figure 3:
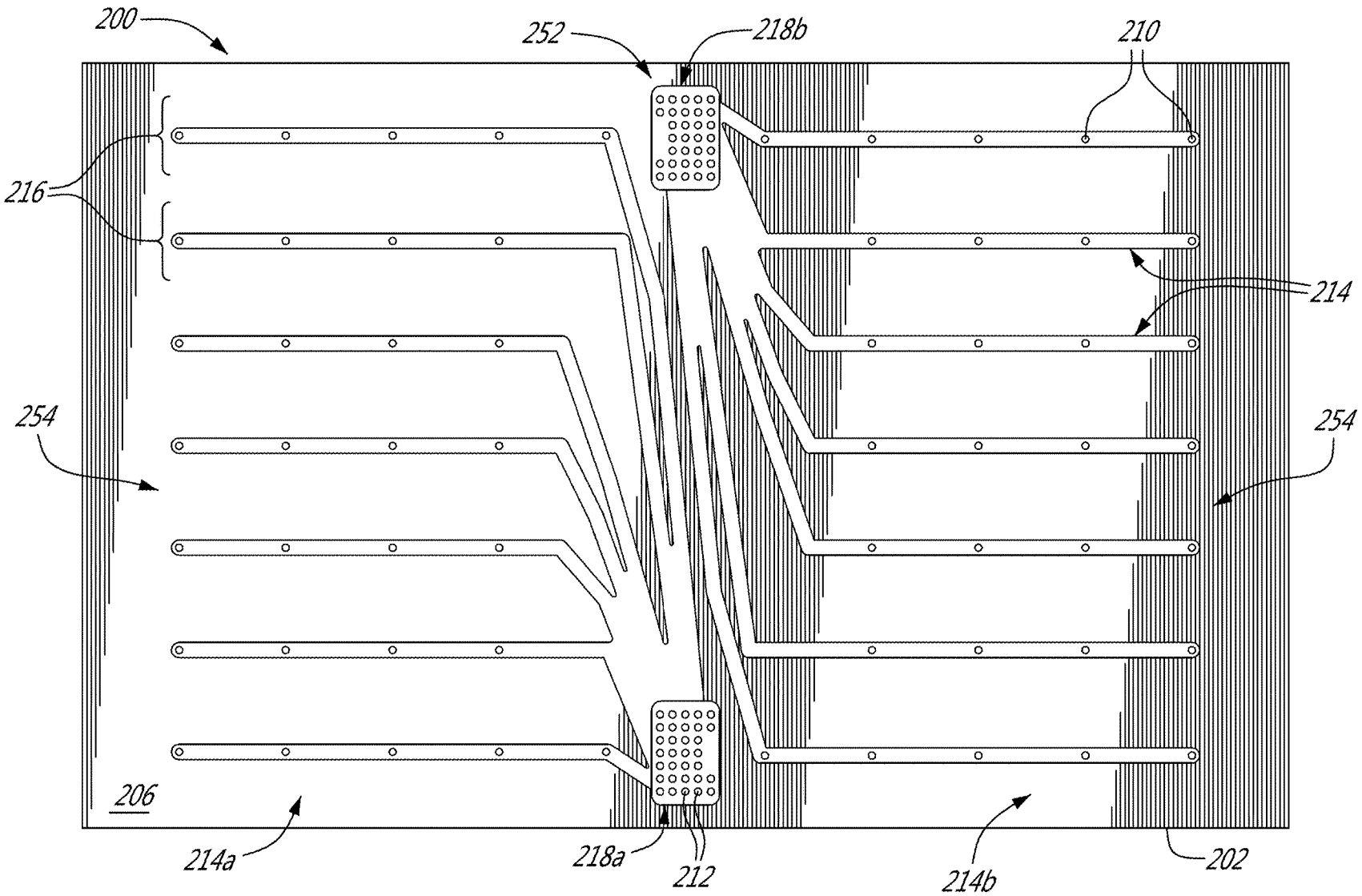
FIG. 3 is a schematic bottom view of the support of FIG. 1.

Referring to FIGS. 1-3, an assembly 100 in accordance with a particular embodiment is shown. The assembly 100 comprises a support 200 configured to be received on a shaker, for example to be retained by existing spring holders of the shaker. The assembly 100 further includes bottles 104 or flasks supported by the support 200, one or more sensor(s) or control unit 106 mounted on the support 200, and conduits 108 connecting the bottles 104 to the sensor/unit(s) 106. The support 200 is configured to receive and retain the bottles 104. The support 200 is also configured so that the conduits 108 extend from the bottles 104 through the support 200, are guided underneath the support 200, and then extend back through the support 200 to be connected to the sensor/unit(s) 106. In a particular embodiment, the support 200 accordingly allows for multiple bottles to be processed simultaneously while preventing the conduits 108 from becoming entangled and/or mixed up.

The assembly 100 may be used for any suitable type of processes and/or analyses, including, but not limited to, fermentation analysis using tubing (for feeding substrate to each bottle in fed-batch fermentations, for pH control, for substrate addition, for enzymatic additions or assays, etc.); off gas measurement via a manifold, multi-position valve, or individual sensors (PSI, mass flow, gas chromatography, infrared analysis, etc.); liquid sample analysis for individual bottles via a manifold, multi-position valve, or individual pumps (HPLC, infrared, and YSI); manual sample ports; automation of fermentations in general. Accordingly, the sensor/unit(s) 106 may be any suitable type of sensor including, but not limited to, a pressure sensor, a mass flow sensor, a gas chromatography sensor, and an infrared sensor.

Alternately, the sensor/unit(s) 106 may be any suitable unit adapted to send and/or receive a signal or to send and/or receive part of a content of the bottle (solution, substrate, additive, etc.) to/from the bottles, or any suitable unit, such as for example a unit providing pneumatic controls. Accordingly, the conduits 108 have a configuration suitable to relay the required information or content of the bottle to the sensor(s) 106 or unit and thus may include, for example, one or more wires, fiber optic cables, or suitable tubing.

Now referring more particularly to FIGS. 2 and 3, the support 200 comprises a plate 202 having a first side 204 (FIG. 2) and a second side 206 (FIG. 3) opposed to the first side 204. The plate 202 may be made of any suitable type of material, including, but not limited to, extruded polyvinyl chloride (PVC). In a particular embodiment, the plate 202 is made of multiple layers of material that are individually machined and then glued, or otherwise attached, to one another. Mechanical fasteners may be used for that purpose. Other methods of manufacturing the plate 202 are contemplated.

As shown in FIG. 2, the plate 202 has sample sections 250 including bottle-receiving members 208 defined in the first side 204 of the plate 202 and configured for holding the bottles 104. In the illustrated embodiment, the bottle-receiving members 208 are bottle-receiving openings extending through only a portion of a thickness of the plate 202. The bottle-receiving openings 208 are circular and sized so as to each snuggly receive a respective one of the bottles 104. Other suitable shapes for the bottle-receiving openings 208 are contemplated. In a particular embodiment, the bottles 104 are maintained within the bottle-receiving openings 208 by friction; other means of retention are also possible.

The sample sections 250 further includes first conduit-receiving openings 210 defined through the plate 202 for receiving the conduits 108 extending from the bottles 104. The first conduit-receiving openings 210 extend from the first side 204 to the second side 206 of the plate 202. Each of the bottle-receiving openings 208 is located adjacent an associated one of the first conduit-receiving openings 210.

In the depicted embodiment, two spaced apart sample sections 250 are provided, so that the bottle-receiving openings 208 are distributed in a first group 208*a* and a second group 208*b* spaced apart from the first group 208*a*, and so that the first conduit-receiving openings 210 are similarly distributed in a first group 210*a* and a second group 210*b* spaced apart from each other. Other configurations are also possible.

The plate 202 further includes manifold sections 252 defining second conduit-receiving openings 212 extending from the first side 204 to the second side 206 of the plate 202. The second conduit-receiving openings 212 are configured to receive the conduits 108 to be connected to the sensor(s) 106 received (e.g., mounted) on the first side 204 of the plate 202. In the embodiment shown and as can be seen in FIG. 2, the adjacent bottle-receiving openings 208 are separated from one another by a distance $D_1$ that is greater than a distance $D_2$ separating the adjacent second conduit-receiving openings 212 from one another. The adjacent first conduit-receiving openings 210 are also separated from one another by the distance $D_1$.

In the depicted embodiment, two spaced apart manifold sections 252 are provided, so that the second conduit-receiving openings 212 are distributed in a first group 212*a* and a second group 212*b* spaced apart from each other. A number of the first conduit-receiving openings 210 and a number of the second conduit-receiving openings 212 each at least corresponds to a number of the bottle-receiving openings 208, since each first and second conduit-receiving opening 210, 212 is configured to receive a single conduit 108 and each bottle-receiving opening 208 is configured to receive a single bottle 106. Other configurations are also possible. In a particular embodiment at least one first conduit-receiving opening 210 and at least one second conduit-receiving opening 212 are provided.

Referring more particularly to FIG. 3, in the embodiment shown the manifold sections 252 also each include a respective recess 218*a*, 218*b* defined in the second side 206 of the plate 202; in a particular embodiment, the number of recesses 218*a*, 218*b* correspond to a number of the sensor/unit(s) 106. The first group 212*a* of second conduit-receiving openings 212 is located within the first common recess 218*a* and the second group 212*b* of second conduit-receiving openings 212 is located within the second common recess 218*b* spaced apart from the first recess 218*a*. In a particular embodiment, the recesses 218*a* and 218*b* are used to facilitate the grouping of the conduits and to avoid a bulk that may preclude the support 200 to lay flat on the shaker. In a particular embodiment, the larger space created by the recesses 218*a* and 218*b* allows the conduits 108 to bend and reduce the complexity of passing the conduits through individual paths.

Referring more particularly to FIG. 3, the plate 202 further includes channel sections 254 including one or more channels 214 defined in the second side 206 of the plate 202, and configured for receiving the conduits 108 therein. The channels 214 extend between the first conduit-receiving openings 210 and the second conduit-receiving openings 212. In the depicted embodiment, the channels 214 are grooves formed in the second side 206 of the plate 202. Each of the channels 214 is configured to receive one or more of the conduits. In the embodiment shown, the first conduit-receiving openings 210 are distributed in rows 216, and each row 216 is associated with a respective channel 214 so that the first conduit-receiving openings 210 of the same row 216 all communicate with the respective channel 214. Accordingly, a number of the rows 216 of one of the sample sections 250 corresponds to a number of the channels 214 of one of the channel sections 254. In the illustrated embodiment, a depth of the channels 214 is smaller than a depth of the recesses 218*a* and 218*b*.

In the depicted embodiment, two channel sections 254 are provided, so that the channels 214 are provided in a first group 214*a* and a second group 214*b*. The channels 214 of the first group 214*a* connect the first and second conduit-receiving openings 210, 212 of the first groups 210*a*, 212*a*, and extend from the first group 210*a* of first conduit-receiving openings 210 to converge to the first recess 218*a* to communicate with the second conduit-receiving openings 212 through the recess 218*a*. Similarly, the channels 214 of the second group 214*b* connect the first and second conduit-receiving openings 210, 212 of the second groups 210*b*, 212*b*, and extend from the second group 210*b* of first conduit-receiving openings 210 to converge to the second recess 218*b* to communicate with the second conduit-receiving openings 212 through the recess 218*b*. Other configurations are possible without departing from the scope of the present disclosure.

Referring more particularly to FIG. 2, in a particular embodiment a distribution pattern of the bottle-receiving openings 208 is similar to a distribution pattern of the first and second conduit-receiving openings 210, 212, for example a same or similar number or rows with a same or similar number of openings 208, 210, 212 in corresponding rows. In the embodiment shown, each of the sample sections 250 has seven rows 216 of bottle-receiving openings 208: two outer rows of five bottle-receiving openings 208 and five intermediate rows located between the outer rows and each including four bottle-receiving openings 208. Each bottle-receiving opening 208 is associated with one of the first conduit-receiving openings 210, which are accordingly similarly distributed. Each of the manifold sections 252 has seven rows 216' of the second conduit-receiving openings 212: two outer rows of five second conduit-receiving openings 212 and five intermediate rows located between the outer rows. The two intermediate rows adjacent the outer rows also include five second conduit-receiving openings 212, and the remaining intermediate row include four second conduit-receiving openings 212. The second conduit-receiving openings 212 thus include two additional second conduit-receiving openings 212' with respect to the number of bottle openings 208. In a particular embodiment, the additional second conduit-receiving openings 212' are used to accommodate more conduits 108 in a situation where the bottle receiving openings 208 are smaller such that the plate 202 is able to accommodate more bottles 104.

For example, one of the conduits 108 connected to a bottle received in a specific one 208' of the bottle-receiving openings 208 may be inserted in a corresponding one 212" of the second conduit-receiving openings 212 such that a position of the corresponding second conduit-receiving opening 212" relative to the other second conduit-receiving openings 212 of the same group corresponds to a position of the specific bottle-receiving opening 208' relative to the other bottle-receiving openings 208 of the same group. This may facilitate the connection of the conduits 108 to the sensor 106 and/or the identification of the conduits extending out of the second conduit-receiving openings 212.

Figure 4:
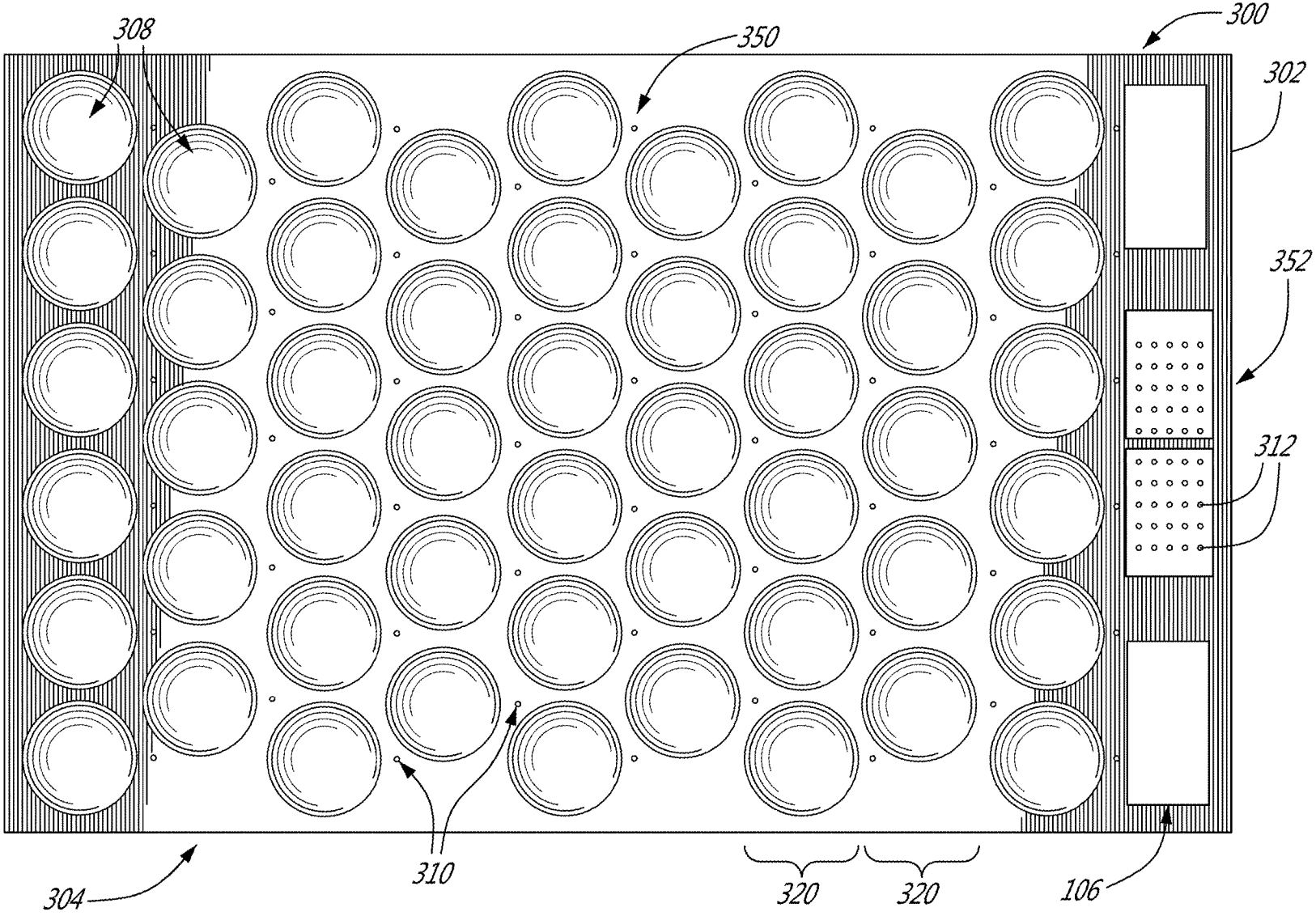
FIG. 4 is a schematic top view of a support in accordance with another embodiment.
Figure 5:
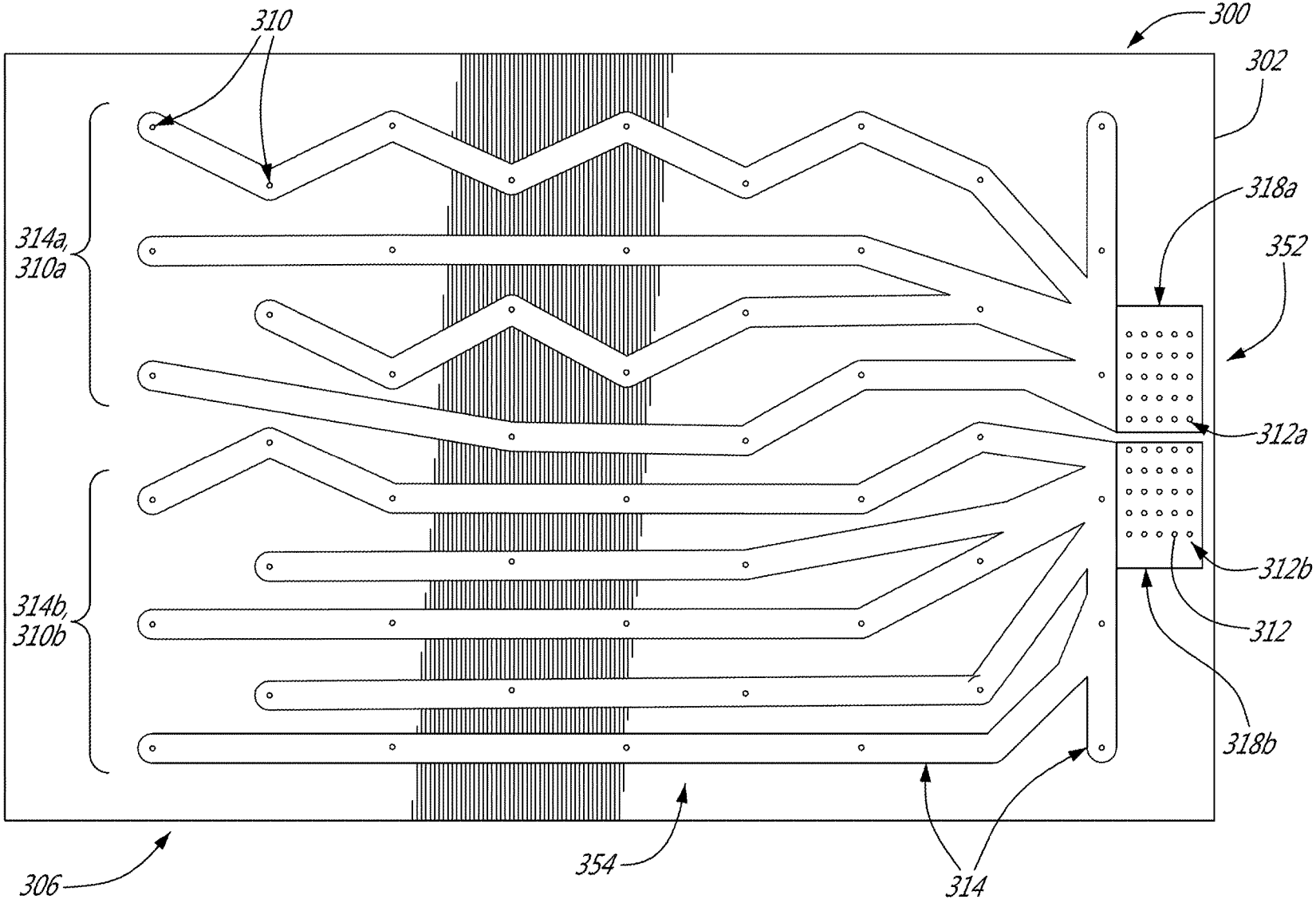
FIG. 5 is a schematic bottom view of the support of FIG. 4.

A support 300 in accordance with another embodiment is shown in FIGS. 4-5. Referring to FIG. 4, the plate 302 has a sample section 350 including bottle-receiving members 308 defined in the first side 304 of the plate 302. The bottle-receiving members 308 are configured for holding bottles, and provided in the form of bottle-receiving openings defined in the first side 304 of the plate 302 and extending through a portion of a thickness of the plate 302. The sample section 350 further defines first conduit-receiving openings 310 for receiving conduits extending from the bottles. The first conduit-receiving openings 310 extend from the first side 304 to the second side 306 of the plate 302.

The plate further includes a manifold section 352 defining second conduit-receiving openings 312 for receiving the conduits. In the depicted embodiment, the manifold section 352 is located adjacent an edge of the plate 302. The second conduit-receiving openings 312 extend from the first side 304 to the second side 306. The manifold section 352 is configured to receive the conduits from the second side 306 to the first side 304 of the plate 302 to be eventually connected to a sensor or other unit 160 received (e.g., affixed) to the first side 304 of the plate 302.

In the illustrated embodiment, a number of the first conduit-receiving openings 310 corresponds to a number of the second conduit-receiving openings 312 and a number of the bottle-receiving openings 308 corresponds to the number of the first conduit-receiving openings 310. Each of the first conduit-receiving openings 310 is located adjacent a respective one of the bottle-receiving openings 308. It is however understood that the number of first conduit-receiving openings 310 and/or the number of second conduit-receiving openings 312 may be different from the number of bottle-receiving openings 308.

The bottle-receiving openings 308 and the first conduit-receiving openings 310 are distributed in columns 320. The bottle-receiving openings 308 of one of the column 320 are offset along an axis L relative to the bottle-receiving openings 308 of an adjacent one of the columns 320. This offset configuration allows the plate 302 to receive more bottles than if the bottle-receiving openings 308 of all columns 320 were aligned.

Referring to FIG. 5, the manifold section 352 also include first and second spaced apart recesses 318*a* and 318*b* defined in the second side 306 of the plate 302, and the second conduit-receiving openings 312 are each defined in one of the recesses 318*a*, 318*b*.

The plate 302 further includes a channel section 354 having channels 314 defined in the second side 306 of the plate 302. The channels 314 are configured for receiving the conduits, which, after exiting the second conduit-receiving openings 312, may be connected to the sensor or unit 106. To accommodate the above described offset of columns 320 of the bottle-receiving openings 308 and of their respective first conduit-receiving openings 310, the channels 314 either have a straight shape, a curved shape, a sinuous shape, or a combination thereof. Each of the first conduit-receiving openings 310 is communicating with an associated one of the channels 314. In the embodiment shown, the channels 314 are grooves defined in the plate second side 306, and the recesses 318*a*, 318*b* have a depth greater than a depth of the channels 314.

The first and second conduit-receiving openings 310 and 312 are distributed in first groups 310*a*, 312*a* and second groups 310*b*, 312*b*. In the illustrated embodiment, the first group 312*a* of the second conduit-receiving openings 312 is received within a first recess 318*a* of the manifold section 352 and the second group 312*b* of the second conduit-receiving openings 312 is received within a second recess 318*b* of the manifold section 352.

The channels 314 are distributed in a first group 314*a* and a second group 314*b*. The channels 314 of the first group 314*a* connect the first and second conduit-receiving openings 310, 312 of the first groups 310*a*, 312*a*, and extend from the first group 310*a* of first conduit-receiving openings 310 to converge to the first recess 318*a* to communicate with the second conduit-receiving openings 312 through the recess 318*a*. Similarly, the channels 314 of the second group 314*b* connect the first and second conduit-receiving openings 310, 312 of the second groups 310*b*, 312*b*, and extend from the second group 310*b* of first conduit-receiving openings 310 to converge to the second recess 318*b* to communicate with the second conduit-receiving openings 312 through the recess 318*b*. Other configurations are possible without departing from the scope of the present disclosure.

In use and in a particular embodiment, to retain bottles 104 and conduits 108 connected thereto, the bottles 104 are engaged in the bottle-receiving members 208, 308 on the first side 204, 304 of the plate 202, 302 of the support 200, 300. Then, the conduits 108 are inserted in a respective one of first conduit-receiving openings 210, 310 so that the conduits 108 extend through the plate 202, 302. The conduits 108 are then guided from the first conduit-receiving opening 210, 310 along the second, opposed side 206, 306 of the plate 202, 302 toward the second conduit-receiving openings 212, 312. Then, the conduits 108 are inserted in a respective one of the second conduit-receiving openings 212, 312 so that the conduits 108 extend through the plate 202, 302.

In the illustrated embodiment, the conduits 108 are guided from the first conduit-receiving openings 210, 310 through channels 214, 314 extending between the first conduit-receiving openings 210, 310 and second conduit-receiving openings 212, 312. In the embodiment shown, the conduits 108 are gathered in two groups each received in a respective one of the two recesses 218, 318 defined in the second side 206, 306 of the plate 202, 302. Each of the channels 214, 314 converges to a respective recess 218, 318.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A support for receiving bottles each connected to a respective conduit, the support comprising:

a plate having a first side and a second side opposed to the first side, wherein:

the first side of the plate has bottle-receiving openings defined therein;

the plate further has first conduit-receiving openings defined therethrough extending from the first side to the second side, each of the bottle-receiving openings adjacent an associated one of the first conduit-receiving openings;

the plate further has at least one second conduit-receiving opening defined therethrough extending from the first side to the second side; and the second side of the plate has at least one channel defined therein, the at least one channel extending between the first conduit-receiving openings and the at least one second conduit-receiving opening;

wherein the first conduit-receiving openings, the at least one channel, and the at least one second conduit-receiving opening are configured so that each of the bottles is receivable within one of the bottle-receiving openings with the respective conduit extending from the bottle through the plate in the associated one of the first conduit-receiving openings, along the second side within one of the at least one channel, and back through the plate in one of the at least one second conduit-receiving opening.

2. The support according to claim 1, wherein the bottle-receiving openings extend only through a portion of a thickness of the plate.

3. The support according to claim 1, wherein a number of the first conduit-receiving openings corresponds to a number of the bottle-receiving openings.

4. The support according to claim 1, wherein the at least one second conduit-receiving opening includes a number of second conduit-receiving openings corresponding to at least a number of the bottle-receiving openings.

5. The support according to claim 1, wherein the first conduit-receiving openings are distributed in rows, the at least one channel including a respective channel associated with each of the rows, the first conduit-receiving openings of each of the rows communicating with the respective channel.

6. The support according to claim 1, wherein the at least one channel is defined by at least one groove formed in the second side of the plate.

7. The support according to claim 1, wherein the at least one second conduit-receiving opening includes first and second spaced apart groups of second conduit-receiving openings, and the at least one channel includes first and second groups of channels, the channels of the first group converging toward the second conduit-receiving openings of the first group, the channels of the second group converging toward the second conduit-receiving openings of the second group.

8. The support according to claim 1, wherein the at least one second conduit-receiving opening includes at least one group of second conduit-receiving openings located within a recess defined in the second side of the plate.

9. A support for receiving bottles, the support comprising:

a plate having a first side and a second side opposed to the first side, the plate having:

a sample section including bottle-receiving members defined in the first side and configured for holding the bottles in a fixed position relative to the plate, and first conduit-receiving openings extending from the first side to the second side for receiving conduits extending from the bottles;

a manifold section including second conduit-receiving openings extending from the first side to the second side for receiving the conduits; and a channel section including channels defined in the second side and extending between the first conduit-receiving openings and the second conduit-receiving openings for receiving the conduits therein.

10. The support according to claim 9, wherein the bottle-receiving members are bottle-receiving openings defined in the first side of the plate.

11. The support according to claim 10, wherein the bottle-receiving openings extend only through a portion of a thickness of the plate.

12. The support according to claim 9, wherein a number of the second conduit-receiving openings corresponds to at least a number of the bottle-receiving members.

13. The support according to claim 9, wherein the conduit-receiving openings include first and second spaced apart groups of second conduit-receiving openings, and the channels include first and second groups of channels, the channels of the first group converging toward the second conduit-receiving openings of the first group, the channels of the second group converging toward the second conduit-receiving openings of the second group.

14. The support according to claim 9, wherein the manifold section includes at least one recess defined in the second side of the plate, and the second conduit-receiving openings are each located within a respective one of at least one recess.

15. The support according to claim 9, wherein a number of the first conduit-receiving openings corresponds to a number of the bottle-receiving members.

16. The support according to claim 9, wherein the first conduit-receiving openings are distributed in rows, the channels including a respective channel associated with each of the rows, the first conduit-receiving openings of each of the rows communicating with the respective channel.

17. An assembly comprising the support of claim 9, the assembly further including:

bottles disposed in the bottle-receiving members;

at least one sensor received on the plate; and conduits connecting the bottles to the at least one sensor, the conduits each extending from a respective one of the bottles through the plate in one of the first conduit-receiving openings, along the second side within one of the at least one channel, and back through the plate in one of the at least one second conduit-receiving opening.

* * * * *